US006070275A

United States Patent [19]

Garlock

[11] Patent Number: 6,070,275

[45] Date of Patent: Jun. 6, 2000

[54] PORTABLE URINE HOLDING SYSTEM

[75] Inventor: Larry Garlock, Bountiful, Utah

[73] Assignee: Med-Assist Technology, Inc., Bountiful, Utah

[21] Appl. No.: 08/998,189

[22] Filed: Dec. 24, 1997

Related U.S. Application Data

[63] Continuation-in-part of application No. 08/651,760, May 22, 1996, abandoned, which is a continuation of application No. 08/334,535, Nov. 4, 1994, abandoned.

[51] Int. Cl.[7] ..... E03D 13/00; A47K 11/12

[52] U.S. Cl. ..... 4/144.1; 604/322

[58] Field of Search ..... 4/144.1–144.4, 4/301, 311, 321, 323, 114.1, 462, 463; 604/324, 322, 329; 224/148.1, 148.2, 148.5, 148.4, 148.7

[56] References Cited

U.S. PATENT DOCUMENTS

| | | | |
|---|---|---|---|
| 2,522,273 | 9/1950 | Johnson . | |
| 3,070,810 | 1/1963 | Jones | 4/458 |
| 3,231,901 | 2/1966 | Kennedy . | |
| 3,259,920 | 7/1966 | Voller . | |
| 3,537,109 | 11/1970 | Spurrier . | |
| 3,626,980 | 12/1971 | Svensson | 4/144.1 |
| 3,650,272 | 3/1972 | Ericson . | |
| 3,703,731 | 11/1972 | Leiser | 4/144.3 |
| 3,716,871 | 2/1973 | Borse . | |
| 4,059,124 | 11/1977 | Hill . | |
| 4,091,476 | 5/1978 | DeBurgh | 4/144.3 |
| 4,117,845 | 10/1978 | Brown | 4/144.1 |
| 4,121,306 | 10/1978 | Bringman et al. | 4/144.3 |
| 4,192,295 | 3/1980 | Sherlock . | |
| 4,270,231 | 6/1981 | Zint . | |
| 4,360,933 | 11/1982 | Kimura et al. . | |
| 4,568,339 | 2/1986 | Steer | 4/144.3 |
| 4,631,061 | 12/1986 | Martin | 4/301 |
| 4,665,571 | 5/1987 | Muccione | 4/144.3 |
| 5,010,599 | 4/1991 | Nilsson . | |
| 5,551,097 | 9/1996 | Short | 4/321 |
| 5,676,296 | 10/1997 | Masters | 224/148.7 |

FOREIGN PATENT DOCUMENTS

| | | |
|---|---|---|
| 2216010 | 10/1989 | United Kingdom . |

*Primary Examiner*—Charles R. Eloshway
*Attorney, Agent, or Firm*—Thorpe, North & Western, LLP

[57] ABSTRACT

A system and method for holding and disposing of urine for patients who are continent includes a urinal, a drainage tube and a urine receptacle. When a continent patient desires to urinate, he or she simply positions the urinal properly and urinates. The urine entering the urinal is conveyed through the urinal and drainage tube and into a receptacle which may be disposed of, or may be used for medical tests. In a preferred embodiment, the drainage tube includes a one-way flow valve to prevent urine in the reservoir from accidentally flowing into the urinal in the event that the urinal is dropped or the reservoir suddenly raised. The system can also include an enclosure member which conceals the receptacle and which holds the receptacle to reduce backflow of urine into the drainage tube.

12 Claims, 5 Drawing Sheets

PORTABLE URINE HOLDING SYSTEM

RELATED APPLICATIONS

The present application is a continuation-in-part of U.S. patent application Ser. No. 08/651,760, filed May 22, 1996, now abandoned, which is a continuation of U.S. patent application Ser. No. 08/334,535, filed Nov. 4, 1994, now abandoned.

BACKGROUND OF THE INVENTION

The present invention relates to a system for holding and disposing of urine for patients, and in particular, to such a system which decreases the risk of the patient developing incontinence and which may be more conveniently concealed than the urine disposal systems of the prior art.

The disposal of urine for non-ambulatory and semi-ambulatory patients is a significant problem for hospitals, nursing homes, and families having a member who is not mobile enough to go to a rest room alone, or who does not go to the rest room for other reasons. When urination is necessary, the person who is continent will usually either call for a care giver to assist him/her, or use a urinal such as that disclosed in U.S. Pat. No. 3,716,871 issued to Borse. At night, it is more common for the patient to use the urinal as care givers are generally less available. Even ambulatory older patients may prefer to use a urinal during the night to avoid the risk of falling when getting out of bed or attempting to navigate in a darkened room and when care givers may not be readily available. For such patients, a fall can result in loss of confidence, a fractured hip, or, occasionally, even death.

While there are several types, urinals are usually a container with a detachable lid and an opening large enough to receive urine. The urinals commonly used, however, have several problems. First, it is common for a patient using such a urinal at night to drop the urinal before the lid is attached, or to knock the urinal off of the night stand on which the urinal is placed while the person is sleeping. Additionally, many patients, though continent, are in a somewhat weakened state and are fearful of reusing the urinal before it has been emptied, because even a momentary slip could cause urine to escape from the urinal and spill on the patient, the patient's bed, or on the floor. In addition to the smell associated with such a spill, the wet floor greatly increases the risk of slipping if the patient attempts to get out of bed.

A further concern with such urinals is that a patient may occasionally mistake the urinal for his/her water bottle during the night. Each of these concerns pose serious drawbacks to the use of conventional urinals.

Because of these concerns, it has become common for the care giver to be called after each urination to empty the urinal. In hospitals and nursing homes this is an inconvenience as the nurses or other medical personnel are required to take time from performing medical activities to empty the urinals. In home environments, the toll is much greater as the care giver is often awakened several times each night to empty the urinal. Eventually, this leads to care giver "burn out" and a loss of self-esteem for the patient.

In response to these concerns, some have resorted to using external and internal catheters and similar devices on patients who are continent and semi-ambulatory simply to decrease the stress on the care giver. Such a solution, however, often leads to the patient becoming incontinent, as the body quickly stops controlling the flow of urine once it realizes that it is attached to a urinal. As a result of this, patients who are temporarily semi-ambulatory (i.e., a person who suffers a severe leg fracture) must relearn to control their urination. Often this takes several days and is quite embarrassing to the patient.

Thus, there is needed a urine holding system which safely and effectively disposes of urine without requiring the care giver to empty the urinal between each urination. Additionally, there is a need for a urine holding system which requires the patient to position the urinal before each use so as to prevent induced temporary incontinence.

Still another concern which is raised by the use of conventional urinals is the stigma which is attached to use of the devices. Those using a urinal may feel embarrassed or inferior that they need the devices. Furthermore, even if the person using the urinal is not uncomfortable with the device, visiting relatives and others are often uncomfortable with a bag partially filled with urine being disposed in plain view.

Still another concern with urine disposal systems is that the receptacle or bag poses a potential hazard. More specifically, most receptacles contain valves which may leak, or the plastic forming the receptacle may be punctured or torn by medical equipment or other hazards. In either case, urine may be spilled from the receptacle. The urine poses two serious concerns. First, the urine can cause contamination and risk the spread of disease. Second, the urine on the floor significantly increases the likelihood of the patient or health care professional slipping and suffering an injury.

Thus, there is needed a urine disposal system which enables concealment of the receptacle of the urine to preserve the dignity of the user. Additionally, such a system should provide added protection to prevent spillage of urine in the event that a valve leaks, or the urine disposal receptacle is somehow compromised.

SUMMARY OF THE INVENTION

It is an object of the present invention to provide a urine holding system with which a patient may temporarily dispose of urine without the assistance of a care giver.

It is another object of the present invention to provide a urine holding system which will not increase the likelihood that the patient will become temporarily or permanently incontinent.

It is an additional object of the invention to provide a urine holding system which is inexpensive to manufacture and is disposable.

It is yet another object of the present invention to provide such a urine holding system which prevents urine from spilling on the user.

It is still another object of the present invention to provide a urine holding system which enables the urinal to be readily concealed from view when not in use in order to enable the user to preserve his or her dignity.

It is still another object of the present invention to provide a urine holding system wherein the urinal is held in an enclosure member which decreases the likelihood of urine being spilled on the floor.

The above and other objects of the invention are realized in a urine holding system including a urinal, a drainage tube and a receptacle. The urinal is designed so as to rest on the patient's bed during use, and to direct urine away from the patient and into the drainage tube. Once in the drainage tube, the urine flows down into the receptacle which is typically disposed in an enclosure member which may be disposed adjacent the side of the patient's bed in such a manner that the urinal, the drainage tube and the receptacle may be readily concealed from view when not in use.

When the patient uses the urinal, the urine will flow from the urinal, through the drainage tube and collect in the receptacle. Preferably, the receptacle will be housed within the enclosure member, which will typically be a bag formed in such a manner as to appear to be a soft-walled attache case.

In accordance with one aspect of the invention, the receptacle is made of a clear material and has volume markings on the side of the receptacle so that a care giver can assess the patient's urine, both for clarity and volume.

In accordance with another aspect of the invention, a one-way valve is positioned along the drainage tube so as to prevent urine in the tube or receptacle from spilling in the event that the receptacle is lifted above the patient, or the urinal is accidentally dropped.

In accordance with another aspect of the invention, the receptacle is disposed within the enclosure member so that the receptacle remains in a proper orientation to receive urine from the drainage tube. Thus, the receptacle will not rest on the floor, as is commonly done, with the result that urine back flows partially up the urine drainage tube. Preferably, the receptacle will be held in the enclosure member adjacent the top of the receptacle to facilitate full expansion of the receptacle before backflow is present.

In accordance with another aspect of the present invention, the enclosure member is made out of a liquid repellant material, or has a liquid resistant liner disposed therein. Such material and/or liner decreases the risk of urine spilling on the hospital/nursing home/home floor due to a leaking valve or a receptacle which has been punctured, etc.

BRIEF DESCRIPTION OF THE DRAWINGS

The above, and other objects, features and advantages of the invention, will become apparent from a consideration of the following detailed description presented in conjunction with the accompanying drawings, in which.

DETAILED DESCRIPTION

Figure 1:
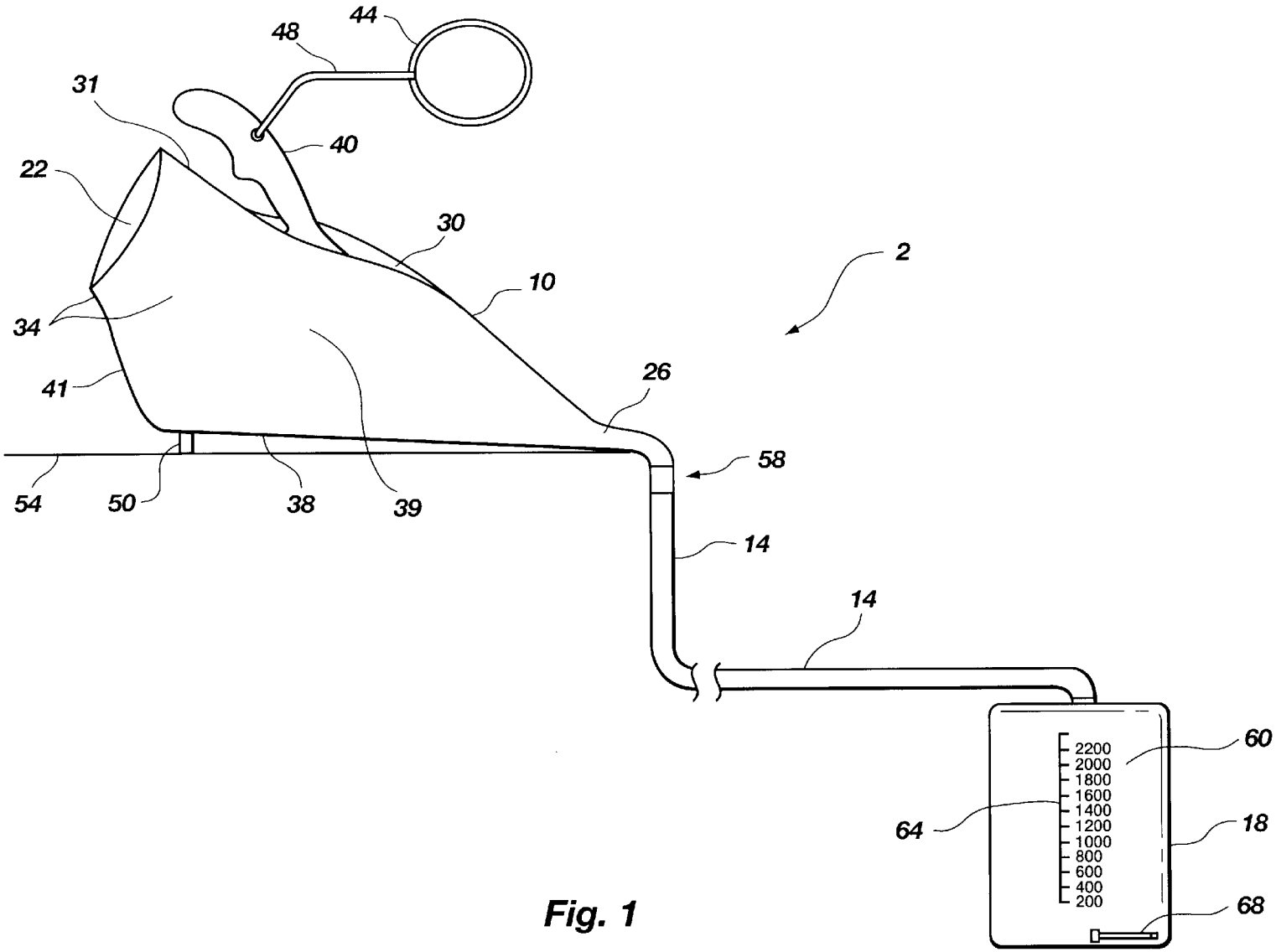
FIG. 1 shows a fragmented, elevated perspective view of a urine holding system made in accordance with the principles of the present invention, the urinal being enlarged.

Reference will now be made to the drawings in which the various elements of the present invention will be given numeral designations and in which the invention will be discussed so as to enable one skilled in the art to make and use the invention. Referring to FIG. 1, there is shown an elevated perspective view of a urine holding system, generally indicated at 2, which includes a urinal 10, a drainage tube 14 and a receptacle 18.

The urinal 10 includes an inlet opening 22 positioned at one end of the urinal and an outlet opening 26 positioned at the opposing end. The space between the inlet opening 22 and the outlet opening 26 is surrounded by an upper wall 30, sidewalls 34 and a bottom wall 38. A portion 31 of the upper wall 30, a portion 41 of the bottom wall 38 and portions of the sidewalls 34 which are disposed adjacent to the opening 22 flare or are tapered outwardly so as to form an enlarged middle portion 39. The walls 30, 34 and 38 then all taper downwardly and toward each other to form a funnel like shape adjacent the outlet opening 26. The configuration shown is easy to fit between one's legs and helps facilitate rapid evacuations of urine from the urinal without pooling, etc.

A handle 40 extends upwardly (or some other convenient direction) from the upper wall 30 so as to enable the patient to move the urinal 10, and to hold it securely in place during use. A lid 44 can also be provided and attached to the handle by a cord 48. When the urinal 10 is not in use, the lid 44 covers the inlet opening 22 to prevent odors from reaching the patient.

Ideally, the top wall 30, side walls 34 and bottom wall 38 should be disposed such that the urinal 10 has a volume of about 600 cubic centimeters. This ensures that the urinal will not overflow in the event that the patient urinates faster than the urine is carried away by the drainage tube 14. Those skilled in the art will recognize that the likelihood of such overfilling could be alleviated by simply increasing an interior diameter of the drainage tube 14.

As shown in FIG. 1, a pair of legs 50 can be attached to an outer surface of the bottom wall 38 so that the bottom wall slopes downwardly from the inlet opening 22 to the outlet opening 26 when the urinal 10 is placed on a flat bed (represented by line 54). This slope causes the urine to flow into the drainage tube 14 rather than merely pool on the bottom wall 38. Preferably, the legs will be between ½ inch and 1 inch so as to provide a slope sufficient to direct the urine into the drainage tube 14, without rendering the urinal 10 unstable when placed on a patient's bed, etc.

In use, a patient will get into a comfortable position and then position the urinal inlet opening 22 properly. The patient then releases urine into the urinal 10 through the opening 22 and the urine is channeled by the upper wall 30, sidewalls 34 and bottom wall 38 to the outlet opening 26, where the urine passes into the drainage tube 14. Typically, the drainage tube 14 will have a one-way valve, indicated at 58, to prevent fluids from flowing back into the urinal 10 in the event that the urinal is dropped, or the receptacle 18 is suddenly lifted above the urinal. The valve 58 can be a diaphragm valve, a ball valve, a flutter valve. In FIG. 1, the one-way valve 58 is disposed adjacent to the urinal 10. However, it will be equally common for the one-way valve 58 to be disposed at the junction between the drainage tube 14 and the receptacle 18.

In addition to preventing backflow of urine, the valve also serves to minimize the spreading of foul odors which might develop in the receptacle if the urinal is allowed to sit between uses. With such a valve in place, residual amounts of urine within the urinal would typically produce more odors than would be released through the valve.

Because urinals are commonly used at night, they are frequently dropped by patients, causing urine to spill on the floor of the room, leaving a foul odor and increasing the risk of infection. The spilled urine also increases the risk that the patient or medical personnel will slip and fall. By providing the one-way valve 58, the only amount of urine which may spill on the floor is that which has not passed through the valve. This will usually be a small quantity which can easily be cleaned up. For this reason, it is prefered to position the one-way valve 58 at a location near the urinal 10. However, this may not always be practical or economical, and providing the one-way valve 58 nearer to the receptacle 18 will still significantly limit the amount of spilled urine.

Once the urine passes through the drainage tube 14, it enters the receptacle 18. The receptacle 18 will typically be a plastic bag which has at least one transparent face 60 so that the care giver can observe the clarity of the urine, and be alerted if there are any problems such as blood in the urine. The receptacle 18 will also usually be graduated; i.e., it will have markings, such as those indicated at 64, for determining the quantity of urine produced by the patient during a given period of time. Additionally, while the receptacle 18 can be thrown away each morning and replaced with a new receptacle, the receptacle will typically have a discharge valve 68 for draining the receptacle, and for taking urine samples when needed.

Figure 2:
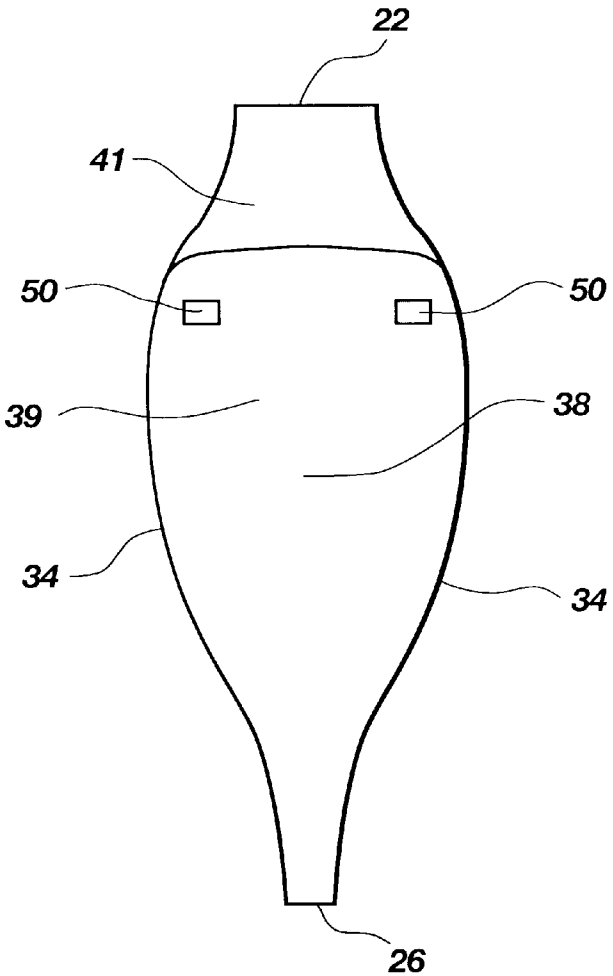
FIG. 2 shows a bottom view of the urinal shown in FIG. 1.

Referring now to FIG. 2, there is shown a bottom view of the urinal 10 shown in FIG. 1. The urinal 10 is fairly wide at the sidewalls 34 and along most of the bottom wall 38 so as to provide stability when placed on the patient's bed. The legs 50 are also spaced apart to provide additional stability when placed on a patient's bed. The urinal 10, however, narrows near the outlet opening 26 like a funnel so as to channel the urine into the drainage tube (not shown in FIG. 2). This narrowing portion, in conjunction with the other structures of the urinal also assist in the prevention of pooling of urine. Of course, urine which pools within the urinal 10 is likely to cause odors. Therefore, the prevention of pooling makes the urinal much more convenient to use, as the urinal need not be rinsed as often as many prior art devices.

Figure 3:
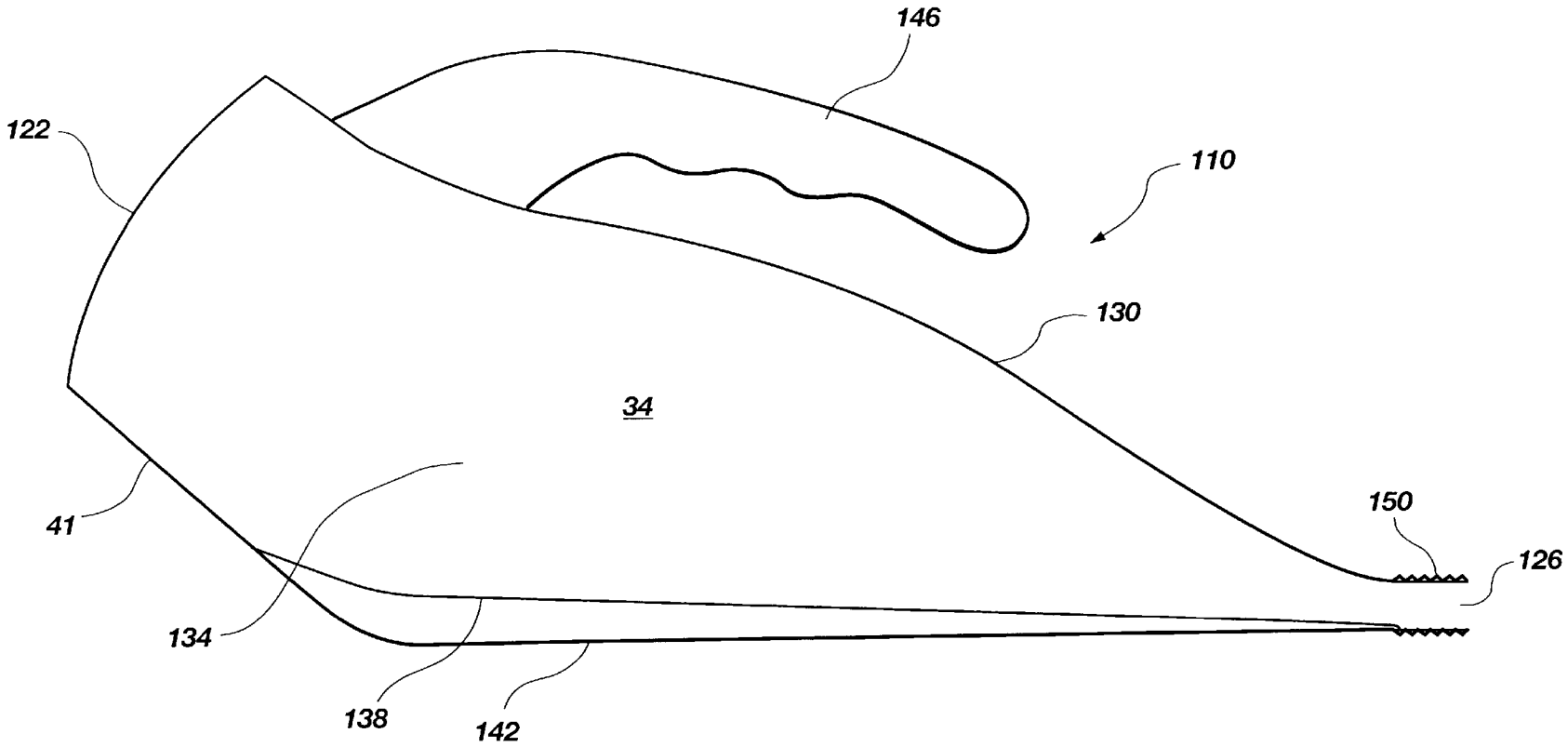
FIG. 3 shows a side-cross sectional view of another embodiment of a urinal made in accordance with the principles of the present invention.

Referring now to FIG. 3, there is shown a side cross-sectional view of an alternate embodiment, generally indicated at 110 of the urinal 10 of FIGS. 1 and 2. The urinal 110 includes an inlet opening 122 and an outlet opening 126. The space between the openings 122 and 126 is surrounded by a top wall 130, side walls 134 and an interior bottom wall 138 which taper outwardly as they extend from the inlet opening, and then taper inwardly as they approach the outlet opening 126.

As shown in FIG. 3, the interior bottom wall 138 is sloped so as to direct urine to the outlet opening 126. The interior bottom wall 138 forms what is commonly referred to as a false bottom within the urinal 110. Ideally, the false bottom (interior bottom wall 138) will slope between ¼ and ¾ inch over the length of the urinal to provide proper drainage.

The bottom side of the urinal 110 is provided by an exterior bottom wall 142. The exterior bottom wall is generally flat so that the urinal 110 may rest horizontally on a bed while being used by a patient. As with the bottom wall 38, shown in FIG. 2, the exterior bottom wall 142 will be relatively broad to give the urinal 110 lateral stability, and limit the risk that the urinal will be knocked over accidentally. This stability not only makes the urinal 110 easier to use, it also decreases the fears of users who are worried about accidentally spilling the contents of the urinal on themselves while attempting to use a urinal during the night. The swift drainage and other benefits of the present invention, however, significantly decrease the chances that such a spill will occur.

As shown in FIG. 3, the urinal 110 also includes a handle 146 which extends from the upper wall 130 to facilitate movement of the urinal by a patient. The handle 146 should be comfortable and easy to grip as the handle will be used each time the patient desires to urinate. Unlike other systems which have been developed, the urinal 110 should not be permanently attached to the patient. If this is done, the risk of temporary or permanent incontinence increases significantly. By being unattached, the urinal 110 forces the patient to make a conscious decision about whether to urinate.

Also shown in FIG. 3, an attachment 150 is provided about the exterior of the outlet opening 126 for attaching the drainage tube (not shown) to the urinal 110. A barbed attachment, such as that shown as 150, would allow the care giver to remove the drainage tube and replaced it with a fresh one. One presently preferred embodiment includes forming the urinal 110 from a polypropylene material, and the drainage tube from polyvinyl chloride. The two materials essentially form a seal about the barbs 150. In another presently preferred embodiment, the drainage tube (not shown in FIG. 3) is adhesively attached to the urinal and to the receptacle (not shown in FIG. 3). Rather than portions being thrown away, the urine system may be washed to prevent the build-up of odors or bacteria.

While a barbed or adhesive attachment may be presently preferred, those skilled in the art will recognize, however, that a threaded attachment, a force-fit attachment, a clamp attachment or some other securing means could also be used to secure the urinal to the drainage tube. A threaded or otherwise releasable attachment is particularly beneficial if the drainage tube and the receptacle (not shown) were formed as one integral unit and are intended to be disposed of periodically. The urinal could then be rinsed out to prevent any trace urine from developing unpleasant odors prior to attachment to the drainage tube. If the entire unit was to be thrown away or cleaned for reuse, the drainage tube could be adhesively attached to the urinal 110, or the urinal and drainage tube could be formed as one piece.

Figure 4A:
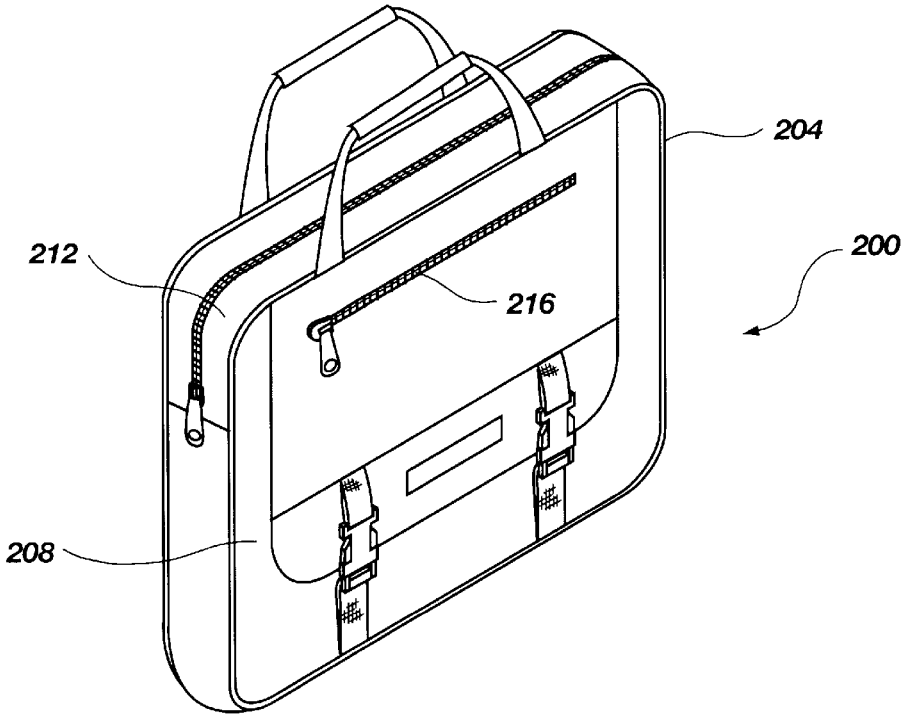
FIG. 4A shows a perspective view of an enclosure member made in accordance with the principles of the present invention.
Figure 4B:
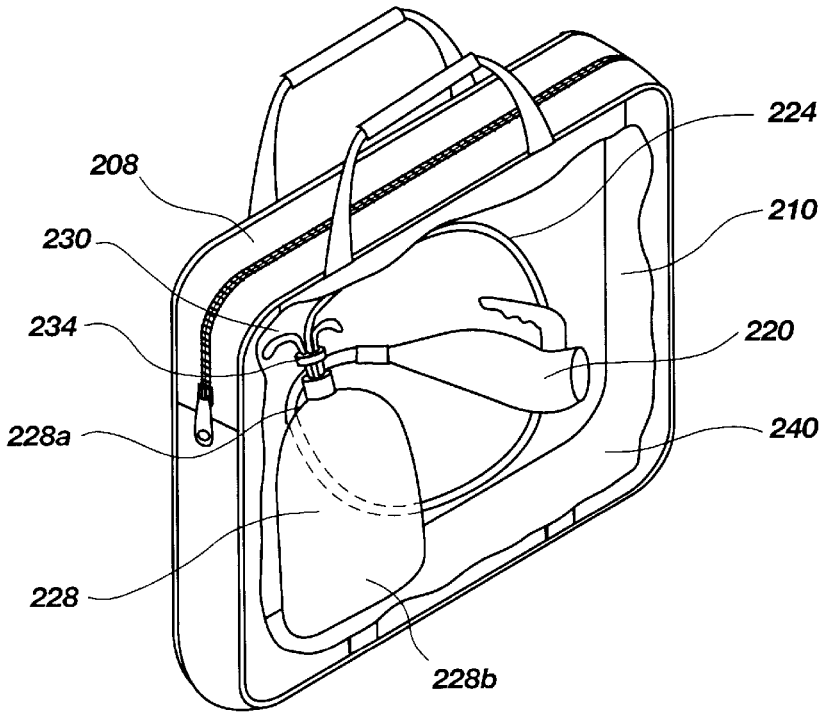
FIG. 4B shows a cut-away perspective view of the enclosure member shown in FIG. 4A with a urinal, a disposal tube, and a receptacle disposed therein in accordance with the principles of the present invention.
Figure 4C:
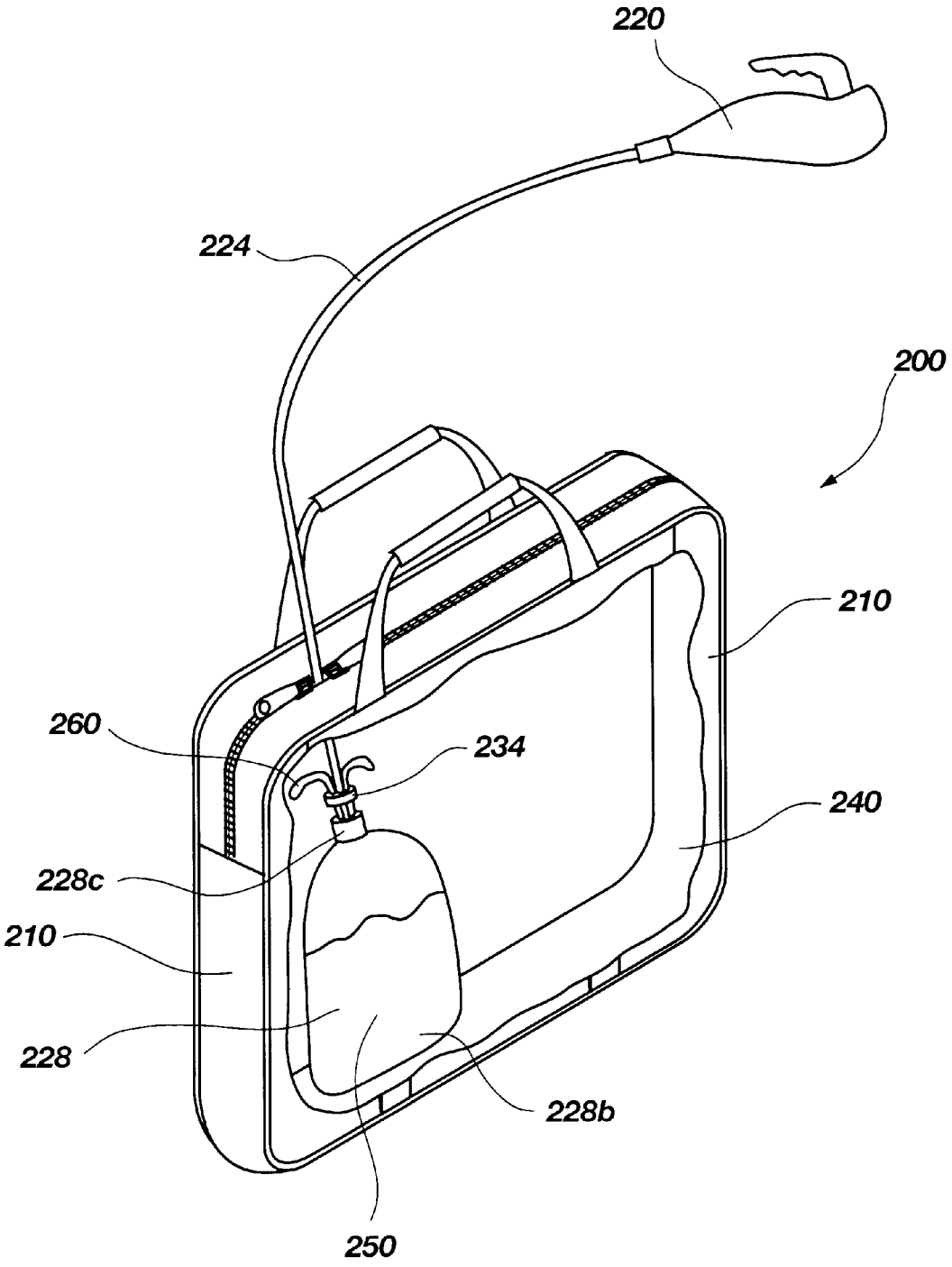
FIG. 4C shows a cut-away perspective view with the urinal disposed outside of the enclosure member, as it would be during use, and the drainage tube connecting the urinal and the receptacle disposed in the enclosure member.

Turning now to FIGS. 4A through 4C, there is shown yet another aspect of the principles of the present invention. As was mentioned briefly in the background section, one of the most difficult aspects of using a urine disposal system as that set forth above is the humiliation associated with not being able to use a restroom when one needs to urinate. While the presence of a urinal alone may not cause concern to the majority of patients, the presence of a receptacle which is partially filled with urine is embarrassing. Thus, FIG. 4A shows an enclosure member 204 which is formed with the appearance of an opaque soft-sided attache case 208. For the purposes of the present invention, a conventional soft-sided attache case could be used. However, as will be discussed below, certain advantages can be achieved by customizing the case 208.

The case 208 will typically have a large central pocket 210, contained within the portion indicated at 212, and may include a plurality of other pockets 216 which may be used to store medication or other items. As shown in FIG. 4B, the central pocket 210 is configured to receive a urinal 220, a drainage tube 224 and a receptacle 228. Of course, the central pocket 210 may be formed with special straps or contours to receive the urinal 220 and the drainage tube 224. However, this is not necessary.

It is highly desirable, however, that the receptacle 228 be attached to the case 208. Preferably, the receptacle 228 is attached to the wall 230 of the case 208 adjacent an upper side thereof. A strap made of hook and loop fastener 234 works well for this purpose and allows the receptacle 228 to be removed when necessary for draining, etc. of course, numerous other fasteners, such as snaps or manually lockable straps could be used to secure the receptacle.

While discussed above as being a soft-sided attache case, the case 208 should have sufficient rigidity to hold the upper portion 228*a* of the receptacle several inches above the lower end 228*b* of the receptacle.

By holding the upper portion of the receptacle 228, fastener 234 allows the receptacle to be suspended and thereby allows urine to fill the receptacle relatively unimpeded. This is in contrast to the common practice of simply leaving the receptacle on the floor where the weight of the urine tends to promote backflow into the drainage tube.

Not only does the case 208 hold the receptacle 228 upright and substantially reduce backflow into the drainage tube 224, it also helps to protect the receptacle 228 from being punctured or torn to thereby prevent the urine from spilling on the floor. As was noted in the background section, an exposed urine receptacle raises health problems due to disease and due to slipping, etc., if the bag is punctured or torn. Because of concerns in this regard, some nursing homes and other similar facilities now prohibit exposed urine receptacles. By utilizing the privacy case 208 of the present invention, the receptacle is protected from damage, and concealed in a manner which is the least embarrassing to the user.

Additionally, even if the receptacle were to leak or spill, the case 208 of the present invention provides a secondary containment enclosure which prevents widespread spilling of urine. Preferably, the case 208 has a liner 240 which is liquid resistant or liquid proof so that, if the receptacle were to spill, the case would contain the urine.

Turning now specifically to FIG. 4C, there is shown a partial cut-away view similar to that shown in FIG. 4B. The receptacle 228 is supported in a generally vertical position by the fastener 234 to allow urine 250 in the receptacle to gravitate toward the end opposite the opening 228*c* disposed in communication with the drainage tube 224. Thus, when the patient uses the urinal 220, the urine flows through the urinal, through the drainage tube 224 and into the receptacle 228. Backflow into the drainage tube 224 will not begin until the receptacle is nearly full.

In addition to ensuring proper filling of the receptacle 228, the privacy case 208 also helps to conceal the receptacle full of urine 250 and makes the overall urine disposal system less obvious to those not familiar with the device. Once the user has finished urinating, the urinal 220 is held in place for a few seconds to enable the urine to drain from the drainage tube 224 and then replaces the urinal and the drainage tube back in the case 208. If proper draining of the draining tube has not occurred, the liquid resistant liner 240 of the case will contain the small amount of urine which may escape.

In order to help provide maximum camouflage to the urine disposal system 200, the case 208 will preferably have two zippers which can be used to close all but a small hole for the drainage tube. Such zippers are well known on conventional carrying bags and soft-sided attache cases.

In the manner described, an improved Urine Holding System is provided. The system utilizes a urinal, a drain tube, and a receptacle to remove urine and decrease the likelihood that a patient will spill on himself/herself. Unlike other systems, the urinal is not strapped to the patient, thereby decreasing the likelihood that a patient will become temporarily (or permanently) incontinent. Rather, the urinal can be mounted in a holder which prevents the urinal from interfering with other activities of the patient. The invention further can also include the use of a privacy case which conceals the urine receptacle to minimize embarrassment to the user. Furthermore, the privacy case may be configured to facilitate improved filling of the receptacle.

It is to be understood that the above-described arrangements are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed is:

1. A portable urine holding system comprising:

a case having a bottom;

a flexible bag, disposed in the case, configured for receiving urine and expanding as urine is received, the flexible bag having upper and lower ends, and further having an inlet opening in the upper end;

an attachment for attaching the upper end of the flexible bag to the case to allow the flexible bag to expand as the flexible bag fills with urine, the attachment further suspending the flexible bag above the bottom of the case to prevent flowback of urine through the inlet opening of the flexible bag;

a urinal configured for receiving the urine from a patient and having an inlet opening and an outlet opening; and a drainage tube in fluid communication with the outlet opening of the urinal and the inlet opening of the flexible bag, the drainage tube extending through the case.

2. The portable urine holding system of claim 1, wherein the flexible bag has a neck at the upper end, and wherein the attachment attaches around the neck to allow the flexible bag to flex as urine is received in the flexible bag.

3. The portable urine holding system of claim 1, wherein the flexible bag is transparent to enable viewing of the urine and volume of the urine in the flexible bag, and wherein the case is opaque to conceal the flexible bag.

4. The portable urine holding system of claim 1, wherein the case is sized and configured to removably receive the urinal and the drainage tube, and wherein the urinal and the drainage tube are selectively and removably disposed in the case.

5. The portable urine holding system of claim 1, wherein the urinal has walls which taper outwardly from the inlet opening and then taper inwardly toward the outlet opening.

6. A portable urine holding system comprising:

a case having a wall and a bottom;

a flexible and expandable bag, disposed in the case to conceal the bag, configured for receiving urine and expanding as urine is received, the flexible and expandable bag having upper and lower ends, and further having an inlet opening in the upper end;

an attachment for attaching the upper end of the flexible and expandable bag to the wall of the case to allow the bag to expand as the bag fills with urine, the attachment further suspending the bag above the bottom of the case and in an upright orientation with the inlet opening of the bag above the lower end of the flexible bag to prevent flowback of urine through the inlet opening of the bag;

a urinal, selectively and removably disposed in the case, configured for receiving the urine from a patient and having an inlet opening and an outlet opening; and a drainage tube, selectively and removably disposed in the case, and in fluid communication with the outlet opening of the urinal and the inlet opening of the flexible and expandable bag.

7. The portable urine holding system of claim 6, wherein the flexible and expandable bag has a neck at the upper end, and wherein the attachment attaches around the neck to allow the bag to flex as urine is received in the bag.

8. The portable urine holding system of claim 6, wherein the flexible and expandable bag is transparent to enable viewing of the urine and volume of the urine in the bag, and wherein the case is opaque to conceal the bag.

9. The portable urine holding system of claim 6, wherein the urinal has walls which taper outwardly from the inlet opening and then taper inwardly toward the outlet opening.

10. A portable urine holding system comprising:

a urinal, configured for receiving the urine from a patient, and having a wall defining a container with an inlet opening disposed at one end and an outlet opening disposed at an opposite end, a portion of the walls tapering outwardly away from the inlet opening forming an enlarged middle portion for receiving the urine and resisting overflow of the urine out of the container, and a portion of the walls tapering inwardly and downwardly toward the outlet opening to channel urine through the outlet opening; and a case having a wall and a bottom;

a flexible bag, disposed in the case, configured for receiving the urine and expanding as the urine is received, tile flexible bag having upper and lower ends, and further having an inlet opening in the upper end;

an attachment for attaching the upper end of the flexible bag to the wall of the case to allow the flexible bag to expand as the flexible bag fills with urine, the attachment further suspending the flexible bag above the bottom of the case to prevent flowback of urine through the inlet opening of the flexible bag;

a drainage tube, selectively and removably disposed in the case, and in fluid communication with the outlet opening of the urinal and the inlet opening of the flexible bag.

11. The portable urine holding system of claim 10, wherein the flexible bag has a neck at the upper end, and wherein the attachment attaches around the neck to allow the flexible bag to flex as urine is received in the flexible bag.

12. The portable urine holding system of claim 10, wherein the flexible bag is transparent to enable viewing of the urine and volume of the urine in the flexible bag, and wherein the case is opaque to conceal the flexible bag.

* * * * *